United States Patent [19]

Mori

[11] 4,405,337

[45] Sep. 20, 1983

[54] FUEL FOR DIESEL ENGINE

[75] Inventor: Mitsuyoshi Mori, Amagasaki, Japan

[73] Assignee: Yanmar Diesel Engine Co., Ltd., Osaka, Japan

[21] Appl. No.: 378,814

[22] Filed: May 17, 1982

Related U.S. Application Data

[63] Continuation of Ser. No. 166,844, Jul. 8, 1980, abandoned.

[30] Foreign Application Priority Data

Apr. 10, 1980 [JP] Japan ..... 55-47132
May 14, 1980 [JP] Japan ..... 55-63515

[51] Int. Cl.[3] ..... C10L 1/08
[52] U.S. Cl. ..... 44/56; 44/57
[58] Field of Search ..... 44/56, 57

[56] References Cited

U.S. PATENT DOCUMENTS 1,296,902 3/1919 Backhaus ..... 44/56
1,775,461 9/1930 Hudson ..... 44/56

*Primary Examiner*—Charles F. Warren
*Assistant Examiner*—Y. Harris-Smith
*Attorney, Agent, or Firm*—Armstrong, Nikaido, Marmelstein & Kubovcik

[57] ABSTRACT

Disclosed is a fuel for a diesel engine which comprises a mixture of (A) an alcohol, (B) gas oil and (C) castor oil, wherein the contents of the respective components satisfy requirements represented by the following formulae:

0% by volume $<A\leqq 80\%$ by volume,
10% by volume $\leqq B<50\%$ by volume, and
10% by volume $\leqq C<50\%$ by volume.

4 Claims, 4 Drawing Figures

FUEL FOR DIESEL ENGINE

This is a continuation of application Ser. No. 166,844, filed July 8, 1980, now abandoned.

BACKGROUND OF THE INVENTION (1) Field of the Invention

The present invention relates to a fuel for a diesel engine. More particularly, the present invention relates to a fuel for a diesel engine, which comprises an alcohol, gas oil and castor oil in appropriately adjusted amounts.

In the instant specification and appended claims, by the term "gas oil" is meant a fraction distilled at about 200° to about 360° C. from petroleum, which also is called "diesel oil".

(2) Description of the Prior Art

An alcohol fuel has been considered as means for coping with expected exhaustion of petroleum or for preventing environmental pollution by exhaust gases. An alcohol is low in the vapor pressure and has a large heat of gasification, and since the cetane value of the alcohol is very low, the auto-ignition characteristic is poor and it is impossible to use such alcohol alone as a fuel for a diesel engine. Accordingly, there has been proposed a method in which an alcohol is used in combination with a conventional diesel engine fuel, for example, gas oil. However, the alcohol is hardly mixed with gas oil. For example, even if a completely anhydrous alcohol is used, when gas oil is added in an amount larger than 20% by volume at 10° C., phase separation takes place and gas oil is not dissolved. This poor compatibility is conspicuous when the water content in the alcohol is high. Therefore, in view of a high affinity of the alcohol with water, this method can hardly be practically carried out.

An alcohol is hardly soluble in most of ordinary vegetable oils and mineral oils and only castor oil can be mentioned as a vegetable oil capable of dissolving alcohols therein. Accordingly, there has been proposed a method in which an alcohol is mixed with castor oil. However, since the viscosity of castor oil is high, it cannot be used in an amount exceeding 50%, and if the ratio of the alcohol is high, abnormal combustion occurs. Accordingly, such alcohol-caster oil mixture cannot be used as a fuel for a diesel engine.

BRIEF SUMMARY OF THE INVENTION

It is a primary object of the present invention to provide an alcohol-containing fuel for a diesel engine.

The fuel for a diesel engine according to the present invention is a ternary mixture comprising an alcohol, gas oil and castor oil, in which the content of the alcohol is higher than 0% by volume and not higher than 80% by volume, the content of gas oil is not lower than 10% by volume and lower than 50% by volume and the content of castor oil is not lower than 10% by volume and lower than 50% by volume.

In the mixture according to the present invention, the respective components are dissolved in one another, and the mixture has very excellent properties required for a diesel engine fuel.

DETAILED DESCRIPTION OF THE PREFERRED EMBODIMENTS

With a view to developing means for utilizing an alcohol for a diesel engine fuel, we searched for a substance capable of providing a good diesel engine fuel when mixed with an alcohol, and we selected gas oil and castor oil.

Figure 1:
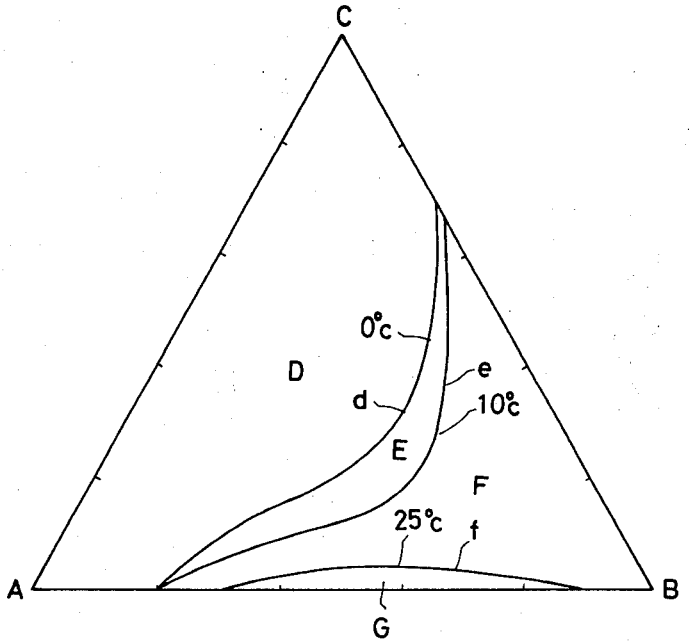
FIG. 1 is a phase diagram of a ternary mixture of an alcohol, gas oil and castor oil at certain temperatures.
Figure 2:
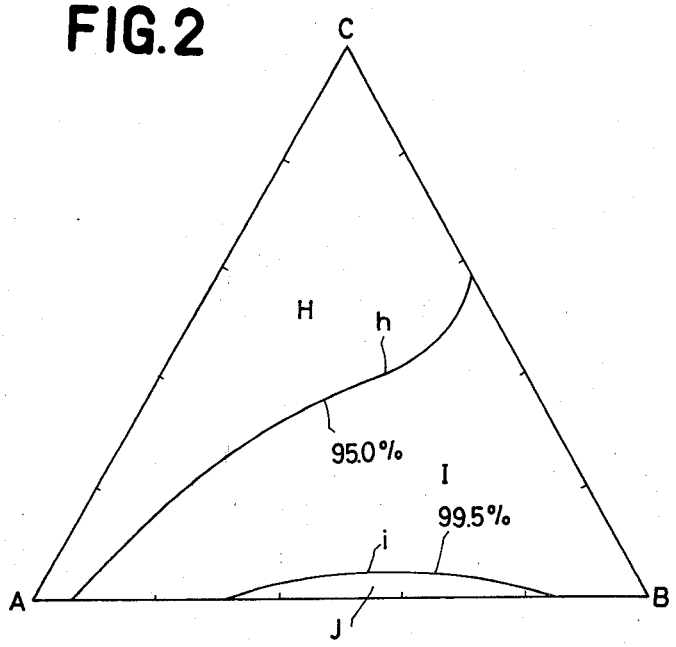
FIG. 2 is a phase diagram of a ternary mixture of an alcohol, gas oil and castor oil, which illustrates influences of the water content in the alcohol.

We made researches on mutual solubilities of an alcohol, gas oil and castor oil and we obtained results shown in FIGS. 1 and 2.

FIG. 1 is a three-component diagram illustrating critical lines causing the phase separation at certain temperatures in alcohol A, gas oil B and castor oil C. In FIG. 1, curves d, e and f indicate critical lines causing the phase separation at 0° C., 10° C. and 25° C., respectively, and regions of respective layers are indicated by D, E, F and G. The alcohol used is 99.5% ethanol. From FIG. 1, it is seen that at 0° C., the respective components are dissolved in the region D above curve d and at 10° C., they are dissolved in the regions D and E above curve e. It also is seen that at 25° C., the three components are dissolved in the regions D, E and F above curve f.

FIG. 2 illustrates results obtained when influences of the water content in the alcohol were examined. The temperature adopted is 25° C. It is seen that when the alcohol concentration is 95.0%, the respective components are dissolved in the region H above curve h. It also is seen that when the alcohol concentration is 99.5%, the respective components are dissolved in the regions H and I above curve i.

Based on the these experimental results, we found that if an alcohol, gas oil and castor oil are mixed at a specific ratio, the mixture can be effectively used as a fuel for a diesel engine.

Figure 4:
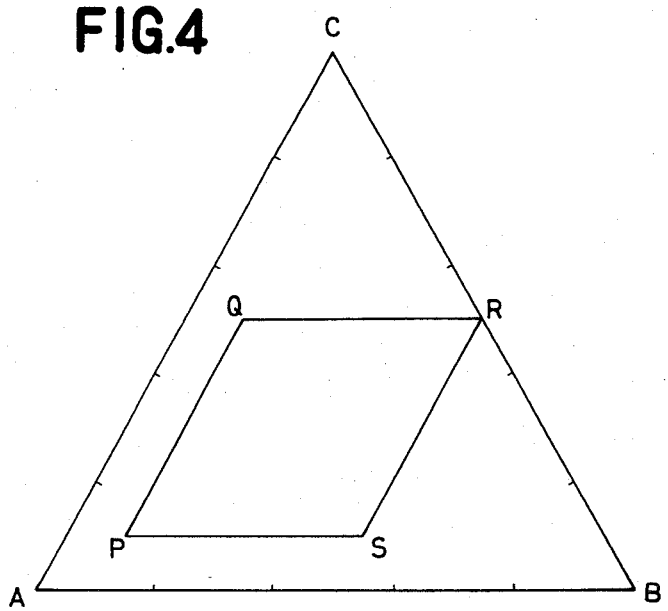
FIG. 4 is a three-component diagram illustrating composition in the fuel according to the present invention.

FIG. 4 shows the mixing ratio range of the mixture according to the present invention. More specifically, referring to FIG. 4, a composition range defined by lines connecting points P, Q, R and S to one another, that is, lines $\overline{PQ}$, $\overline{QR}$, $\overline{RS}$ and $\overline{SP}$, can be used for a mixture that can be used as a diesel engine fuel.

In the present invention, by the term "alcohol" are meant alcohols having 1 to 3 carbon atoms and mixtures thereof. Ethanol is especially preferred. It is preferred that the water content in the alcohol is lower than 3% especially lower than 1%.

Gas oil also is called "diesel oil". This oil is a fraction distilled at about 200° to about 360° C. from petroleum and is defined by JIS K-2204 in Japan, ASTM D-975-66T in the United States, BS 2869–1957 in the Great Britain and DIN 51601 in Germany.

Commercially available castor oil and a similar fatty acid ester can be used as the castor oil in the present invention.

A ternary mixture having a composition included in the range specified in the present invention is characterized in that the respective components are completely soluble in oneanother at temperatures in the range of from 10° to 20° C. Furthermore, this mixture is excellent in spray characteristic and abnormal combustion is not caused. Accordingly, this mixture can be satisfactorily used as a diesel engine fuel.

The combustion temperature of the alcohol is low though the combustion speed is high. Accordingly, the exhaust amount of $NO_x$ is remarkably reduced and soot is hardly formed. Therefore, it is preferred that the amount of the alcohol be increased while the amount of castor oil which is expensive and highly viscous is reduced. More specifically, it is preferred that the mixture of the present invention should comprise 10 to 80% by volume, especially 30 to 70% by volume, of the alcohol, 10 to 45% by volume, especially 20 to 40% by volume, of castor oil, and 10 to 45% by volume, especially 10 to 30% by volume, of gas oil.

The present invention will now be described in detail with reference to the following Examples. Incidentally, all of "%" in these Examples are by volume.

EXAMPLES 1 THROUGH 6

Figure 3:
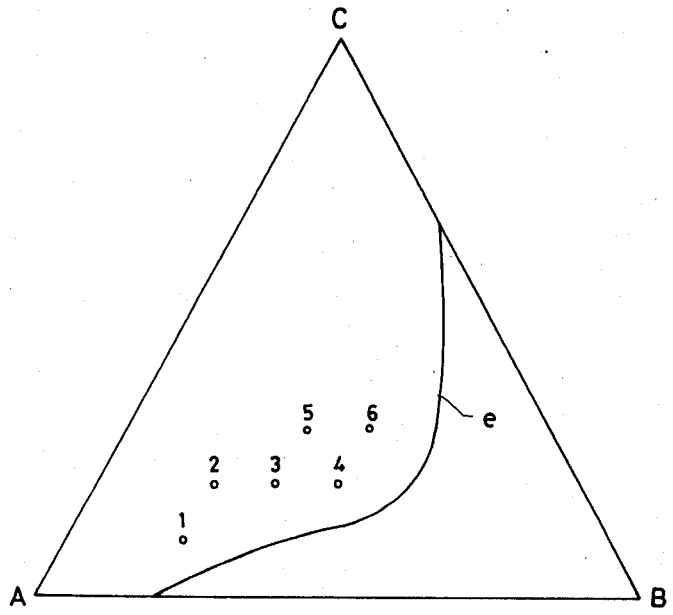
FIG. 3 is a three-component diagram illustrating examples of the composition according to the present invention.

Six minutes were prepared by mixing ethanol (having a water content of 0.5%), gas oil and castor oil at various mixing ratios shown in Table 1. The compositions of these mixtures are shown in FIG. 3. In FIG. 3, curve e indicates the critical line causing the phase separation at 10° C.

It was found that each of these six mixtures of Examples 1 through 6 could be satisfactorily used as a diesel engine oil, though some differences described below were observed in properties of these mixtures.

Each of the mixtures of Examples 4 through 6 having a lower alcohol content was satisfactory in properties required for a diesel engine oil, but from the viewpoint of attainment of the object of using an alcohol as a fuel substitute, these mixtures were not so desirable. The mixtures of Examples 1 through 3 were relatively poor in the starting characteristic, and formation of noises by knocking or occurrence of misfire was observed occasionally.

TABLE 1

| Example No. | Mixing Ratio (% by volume) | | |
|---|---|---|---|
| | Ethanol | Castor Oil | Gas Oil |
| 1 | 70 | 10 | 20 |
| 2 | 60 | 20 | 20 |
| 3 | 50 | 20 | 30 |
| 4 | 40 | 20 | 40 |
| 5 | 40 | 30 | 30 |
| 6 | 30 | 30 | 40 |

What is claimed is:

1. A fuel for a diesel engine which consists essentially of a mixture of (A) an alcohol, (B) gas oil and (C) castor oil, wherein the contents of the respective components satisfy requirements represented by the following formulae:

0% by volume $< A \leqq 80\%$ by volume,

10% by volume $\leqq B < 50\%$ by volume, and

10% by volume $\leqq C < 50\%$ by volume.

2. A fuel for a diesel engine according to claim 1 wherein the contents of the respective components satisfy requirements represented by the following formulae:

10% by volume $< A \leqq 80\%$ by volume,

10% by volume $\leqq B < 45\%$ by volume, and

10% by volume $\leqq C < 45\%$ by volume.

3. A fuel for a diesel engine according to claim 1 wherein the contents of the respective components satisfy requirements represented by the following formulae:

30% by volume $< A \leqq 70\%$ by volume,

20% by volume $\leqq B < 40\%$ by volume, and

10% by volume $\leqq C < 30\%$ by volume.

4. A fuel for a diesel engine according to claim 1 wherein the alcohol is ethanol.

* * * * *